US008093521B2

(12) United States Patent
Wang et al.

(10) Patent No.: US 8,093,521 B2
(45) Date of Patent: Jan. 10, 2012

(54) BUTTON ASSEMBLY

(75) Inventors: Kuo-Hua Wang, Taipei Hsien (TW); Li-Ping Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 615 days.

(21) Appl. No.: 12/198,336

(22) Filed: Aug. 26, 2008

(65) Prior Publication Data

US 2009/0322230 A1 Dec. 31, 2009

(30) Foreign Application Priority Data

Jun. 30, 2008 (CN) ..... 2008 2 0301361

(51) Int. Cl.
*H01H 9/00* (2006.01)

(52) U.S. Cl. ..... 200/314; 200/566

(58) Field of Classification Search ..... 200/310–317, 200/566

See application file for complete search history.

(56) References Cited

U.S. PATENT DOCUMENTS

| | | | | |
|---|---|---|---|---|
| 2,165,199 | A * | 7/1939 | Batcheller | 338/159 |
| 5,399,820 | A * | 3/1995 | Silfvast | 200/314 |
| 6,797,907 | B1 * | 9/2004 | Meagher et al. | 200/564 |
| 7,244,898 | B2 * | 7/2007 | Kim | 200/314 |
| 7,285,738 | B2 * | 10/2007 | Lavigne et al. | 200/4 |

* cited by examiner

*Primary Examiner* — Elvin G Enad
*Assistant Examiner* — Lisa Klaus
(74) *Attorney, Agent, or Firm* — Altis Law Group, Inc.

(57) ABSTRACT

A button assembly includes a button, an indicating lamp, a rheostat and a switch. The button includes a transparent pressing portion. The indicating lamp is positioned in the pressing portion. The rheostat includes a base and an adjuster rotatably attached to the base. The adjuster is rotated by rotation of the button. The switch is capable of being triggered by downwardly movement of the button.

18 Claims, 3 Drawing Sheets

BUTTON ASSEMBLY

BACKGROUND

1. Technical Field

The present invention relates to a button assembly, and more particularly to a button assembly combined with an adjustable rheostat.

2. Description of Related Art

Buttons are typically used in electronic devices to control the power to start up an operation of the electronic device. An indication light is usually positioned adjacent to the button to indicate a working state of the electronic device. The indication light and the button may be separate parts or integrated into one part.

For example, a button device for an electronic device, includes a panel defining an opening, a button module, and a switch. The button module has two opposite ends attached to the panel. The button is suspended at a middle part of the button module and aligned with the opening. A triggering member is movable together with the button. The switch is fixed a pre-determined distance from the panel, and out of alignment with the opening of the panel. The triggering member is laterally inserted between the switch and the panel for triggering the switch when the button is pressed. However, this button device does not include a fine adjustment function such as for volume adjustment or adjusting brightness of a display.

Therefore, a button assembly is desired to overcome the above described deficiencies.

DETAILED DESCRIPTION OF THE EMBODIMENT

Figure 1:
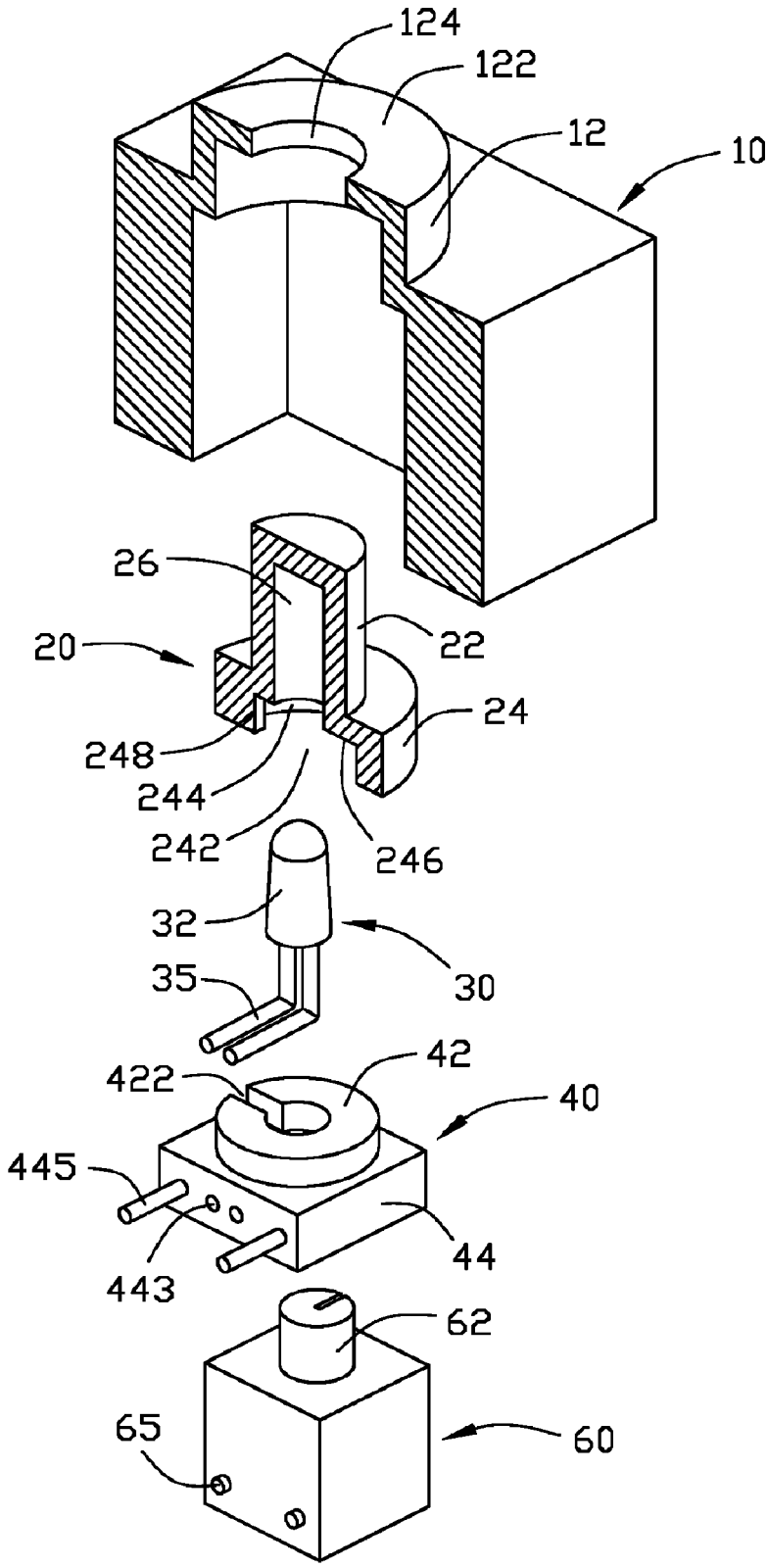
FIG. 1 is an exploded, isometric view of an embodiment of a button assembly of an exemplary embodiment of the present invention.

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

Referring to FIG. 1, an embodiment of a button assembly of an exemplary includes a cover 10, a button 20, an indicating lamp 30, a rheostat 40 and a switch 60.

The cover 10 has a collar portion 12 extending from a top surface of the cover 10. The collar portion 12 has an annular top surface 122. A through hole 124 is defined in the top surface 122.

The button 20 includes an annular holding portion 24 and a cylindrical pressing portion 22 extending from the holding portion 24. The pressing portion 22 may be transparent or semitransparent. The pressing portion 22 defines a lamp receiving space 26. The holding portion 24 defines an assembly space 242 communicating with the lamp receiving space 26. The holding portion 24 includes a circular inner surface 244 and an inner upper surface 246. A driving tab 248 is formed on the inner surface 244.

The indicating lamp 30 includes a head 32 and two lamp pins 35.

The rheostat 40 includes a base 44 and an annular disk-shaped adjuster 42 rotatably attached to the base 44. The adjuster 42 defines a cutout 422 configured for engaging with the driving tab 248. Two lamp pin holes 443 are defined from a lateral surface of the base 44 intersecting a hole defined on a top surface of the base 44 for receiving the lamp pins 35. Two rheostat pins 445 protrude from the lateral surface of the base 44 for providing an adjustable resistance, which can be adjusted by rotating the adjuster 42.

The switch 60 includes a trigger 62 positioned on a top surface of the switch. The trigger 62 is configured to open/close the switch 60 and a signal may be outputted through two switch pins 65, when the trigger 62 is pressed downward.

Figure 2:
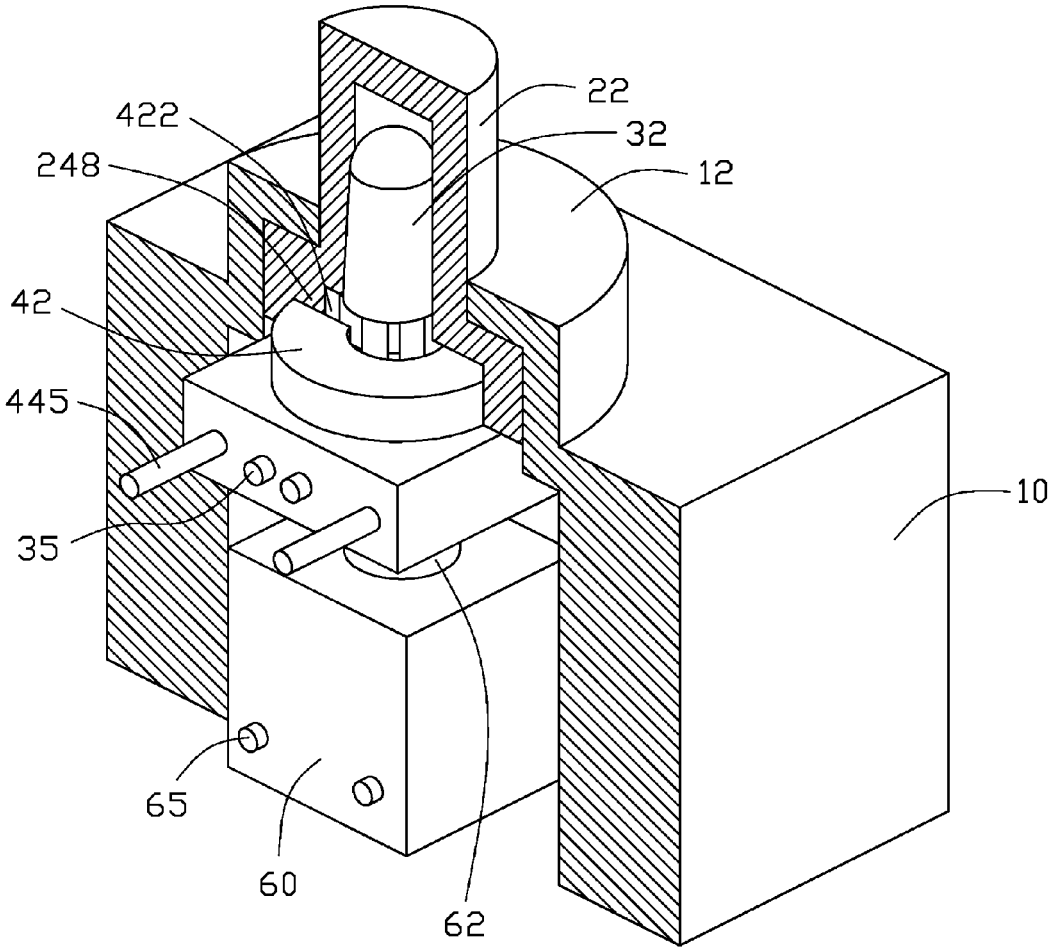
FIG. 2 is an assembled, isometric view of the button assembly of FIG. 1.

Referring also to FIG. 2, the button 20 is received in the cover 10 with the pressing portion 22 protruding through the through hole 124. The indicating lamp 30 is arranged on the rheostat 40 with the lamp pins 35 extending through the lamp pin holes 443 from the top surface of the base 44 and out from the lateral surface of the base 44. The head 32 of the indicating lamp 30 is received in the lamp receiving space 26, the adjuster 42 is received in the assembly space 242, and the drive tab 248 is secured in the cutout 422. A bottom surface of the holding portion 24 abuts the top surface of the base 44. The switch 60 is positioned under the rheostat 40 with a top surface of the trigger 62 abutting a bottom surface of the base 44.

Figure 3:
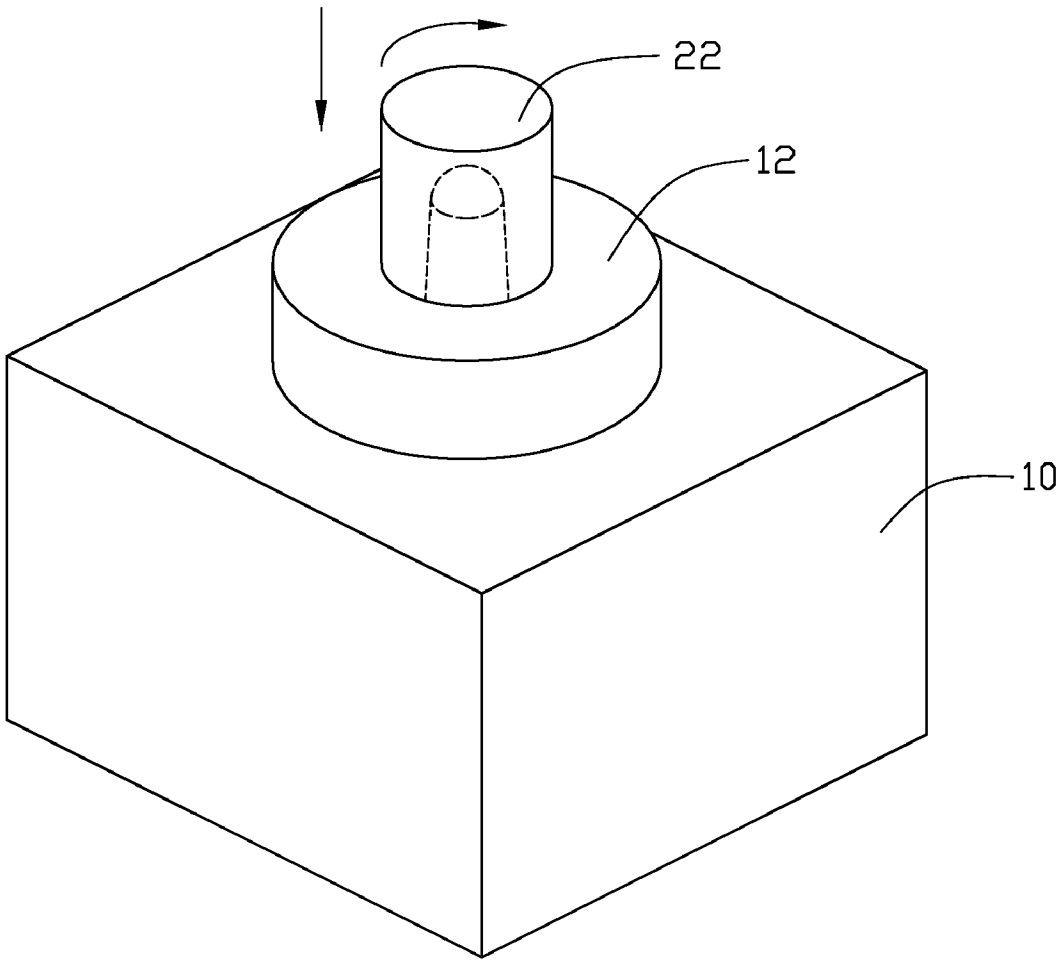
FIG. 3 is a practical application view of the button assembly of FIG. 1.

Referring also to FIG. 3, when the pressing portion 22 is pressed down, the indicating lamp 30, the rheostat 40, and the trigger 62 are also pressed down. The switch 60 may respectively output an open or a close signal to start up or shut down a power. The indicating lamp 30 may be light up to indicate a power state of the device. When the pressing portion 22 is rotated, the adjuster 42 is driven to rotate and the resistance is adjusted to cause a change, such as an audio output volume or a display screen brightness.

It is to be understood, however, that even though numerous characteristics and advantages of the present embodiments have been set forth in the foregoing description, together with details of the structure and function of the embodiments, the disclosure is illustrative only, and changes may be made in detail, especially in matters of shape, size, and arrangement of parts within the principles of the embodiment to the full extent indicated by the broad general meaning of the terms in which the appended claims are expressed.

What is claimed is:

1. A button assembly comprising:

a button comprising a transparent pressing portion;

an indicating lamp positioned in the pressing portion;

a rheostat, comprising a base and an adjuster rotatably attached to the base, the adjuster configured for being rotated by rotation of the button; and a switch capable of being triggered by axial movement of the button;

wherein the indicating lamp is positioned in a middle part of the adjuster, and the indicating lamp comprises at least one lamp pin extending through the base.

2. The button assembly of claim 1, wherein the adjuster is annular disk shaped.

3. The button assembly of claim 1, wherein the button further comprises a holding portion; a driving tab is formed on the holding portion; a cutout is defined in the adjuster and configured for engaging with the driving tab.

4. The button assembly of claim 1, wherein the adjuster is configured for being rotated to change a resistance.

5. The button assembly of claim 4, wherein the resistance corresponds to one of a volume control of an audio output and a brightness of a display screen.

6. The button assembly of claim 1, wherein the switch comprises a trigger abutting the base.

7. The button assembly of claim 1, further comprising a cover, wherein the button, the indicating lamp, the rheostat, and the switch are sequentially arranged in the cover.

8. The button assembly of claim 1, wherein the indicating lamp is configured for indicating a state of power which is started up by triggering the switch.

9. A button assembly comprising:

a button;

a rheostat, comprising a base and an adjuster rotatably attached to the base, the adjuster configured for being rotated by rotation of the button; and a switch capable of being triggered by movement of the base urged by the button.

10. The button assembly of claim 9, further comprising an indicating lamp, wherein the button comprises a transparent pressing portion for receiving the indicating lamp.

11. The button assembly of claim 10, wherein the indicating lamp is positioned in a middle part of the adjuster, and the indicating lamp comprises at least one lamp pin extending through the base.

12. The button assembly of claim 10, wherein the indicating lamp is configured for indicating a state of power which is started up by triggering the switch.

13. The button assembly of claim 9, wherein the adjuster is annular disk-shaped.

14. The button assembly of claim 9, wherein the button further comprises a holding portion; a driving tab is formed on the holding portion; a cutout is defined in the adjuster and configured for engaging with the driving tab.

15. The button assembly of claim 9, wherein the adjuster is configured for being rotated to change a resistance.

16. The button assembly of claim 15, wherein the resistance corresponds to one of a volume control of an audio output and a brightness of a display screen.

17. The button assembly of claim 9, wherein the switch comprises a trigger abutting the base.

18. The button assembly of claim 9, further comprising a cover, wherein the button, the rheostat, and the switch are sequentially arranged in the cover.

* * * * *